US006318573B1

(12) United States Patent
Montero

(10) Patent No.: US 6,318,573 B1
(45) Date of Patent: Nov. 20, 2001

(54) BOTTLE WITH INTEGRALLY FORMED OPENER

(76) Inventor: Roberto L. Montero, 1703 Dodge Ave., Sarasota, FL (US) 34234

( * ) Notice: Subject to any disclaimer, the term of this patent is extended or adjusted under 35 U.S.C. 154(b) by 0 days.

(21) Appl. No.: 09/501,406

(22) Filed: Feb. 10, 2000

(51) Int. Cl.[7] ..... B65D 1/04; B65D 23/08; B65D 23/12

(52) U.S. Cl. ..... 215/6; 215/10; 215/390

(58) Field of Search ..... 215/6, 10, 390; 81/3.15

(56) References Cited

U.S. PATENT DOCUMENTS

| | | | | |
|---|---|---|---|---|
| 279,216 | * | 6/1883 | Berlien | 215/6 |
| 2,745,301 | * | 5/1956 | Grunwald | 215/390 X |
| 2,985,044 | | 5/1961 | Gill | 81/3.4 |
| 4,761,379 | * | 8/1988 | Willams et al. | 215/390 X |
| 4,798,300 | * | 1/1989 | Ghosh et al. | 215/390 X |
| 4,911,038 | | 3/1990 | Ferrin | 81/3.55 |
| 4,967,622 | | 11/1990 | Phillips | 81/3.09 |
| 4,979,407 | | 12/1990 | Hernandez et al. | 81/3.09 |
| 5,022,288 | | 6/1991 | Taktakian | 81/3.4 |
| 5,664,466 | | 9/1997 | Miller | 81/3.25 |

FOREIGN PATENT DOCUMENTS

| | | | | |
|---|---|---|---|---|
| 1524889 | * | 4/1968 | (FR) | 215/10 |
| 1551924 | * | 11/1968 | (FR) | 215/10 |
| 259040 | * | 10/1926 | (GB) | 215/10 |

* cited by examiner

*Primary Examiner*—Sue A. Weaver
(74) *Attorney, Agent, or Firm*—Joseph N. Breaux

(57) ABSTRACT

A beverage bottle with a twist of cap that includes a cap twisting structure molded into a bottom bottle surface thereof that is sized and shaped to gripping hold the twist off cap of another identical bottle. A peel off cover member is positioned over the cap twisting structure to protect it from contamination until it is used.

1 Claim, 2 Drawing Sheets

BOTTLE WITH INTEGRALLY FORMED OPENER

TECHNICAL FIELD

The present invention relates to beverage bottles with twist off bottle caps and more particularly to a bottle with integrally formed opener that includes a twist off bottle cap, a molded glass bottle, and a peel off sanitary cover member; the twist off bottle cap having a number of evenly spaced grippable teeth extending outwardly from an internally threaded center cover portion; the molded glass bottle having a neck portion and a bottom portion; the neck portion terminating in a externally threaded neck member defining a dispensing opening and companionately threaded to engage and hold the twist off bottle cap in sealing relation to the dispensing opening of the externally threaded neck member; the bottom portion having a cap teeth engaging bottle cavity formed into a bottom surface thereof sized to receiving a twist off bottle cap therein and having a number of grippable teeth engaging protrusions that are sized and shaped to fit between evenly spaced grippable teeth of the twist off bottle cap; the peel off sanitary cover member being adhesively secured to the bottom surface of the bottom portion such that the cap teeth engaging bottle cavity is sealingly covered; the peel off sanitary cover member having a grip tab extending from a side edge thereof.

BACKGROUND ART

Many individuals find it difficult to twist off the twist off cap of many beverage bottles. It would be a benefit, therefore, to have a beverage bottle with a twist of cap that included a cap twisting structure molded into a bottom bottle surface thereof sized and shaped to gripping hold the twist off cap of another identical bottle. Because the cap twisting structure is molded into the bottom surface of the bottle where it can become contaminated while sitting on a table, in an ice chest or the like, it would also be a benefit to have a peel off cover member positioned over the cap twisting structure to protect it from contamination until it is used.

GENERAL SUMMARY DISCUSSION OF INVENTION

It is thus an object of the invention to provide a bottle with integrally formed opener that includes a twist off bottle cap, a molded glass bottle, and a peel off sanitary cover member; the twist off bottle cap having a number of evenly spaced grippable teeth extending outwardly from an internally threaded center cover portion; the molded glass bottle having a neck portion and a bottom portion; the neck portion terminating in a externally threaded neck member defining a dispensing opening and companionately threaded to engage and hold the twist off bottle cap in sealing relation to the dispensing opening of the externally threaded neck member; the bottom portion having a cap teeth engaging bottle cavity formed into a bottom surface thereof sized to receiving a twist off bottle cap therein and having a number of grippable teeth engaging protrusions that are sized and shaped to fit between evenly spaced grippable teeth of the twist off bottle cap; the peel off sanitary cover member being adhesively secured to the bottom surface of the bottom portion such that the cap teeth engaging bottle cavity is sealingly covered; the peel off sanitary cover member having a grip tab extending from a side edge thereof.

Accordingly, a bottle with integrally formed opener is provided. The bottle with integrally formed opener includes a twist off bottle cap, a molded glass bottle, and a peel off sanitary cover member; the twist off bottle cap having a number of evenly spaced grippable teeth extending outwardly from an internally threaded center cover portion; the molded glass bottle having a neck portion and a bottom portion; the neck portion terminating in a externally threaded neck member defining a dispensing opening and companionately threaded to engage and hold the twist off bottle cap in sealing relation to the dispensing opening of the externally threaded neck member; the bottom portion having a cap teeth engaging bottle cavity formed into a bottom surface thereof sized to receiving a twist off bottle cap therein and having a number of grippable teeth engaging protrusions that are sized and shaped to fit between evenly spaced grippable teeth of the twist off bottle cap; the peel off sanitary cover member being adhesively secured to the bottom surface of the bottom portion such that the cap teeth engaging bottle cavity is sealingly covered; the peel off sanitary cover member having a grip tab extending from a side edge thereof.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
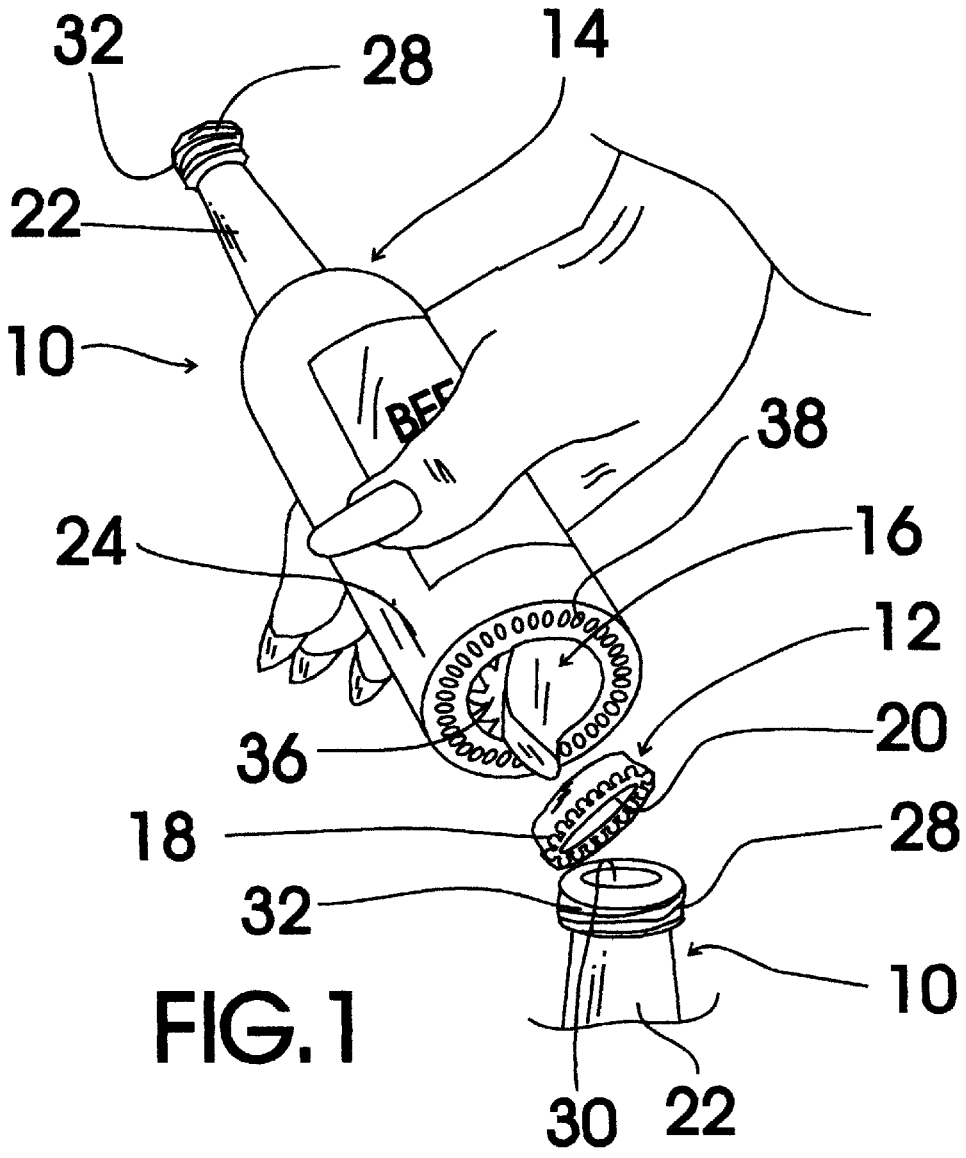
FIG. 1 is a perspective view of an exemplary embodiment of the bottle with integrally formed opener showing the twist off bottle cap, the molded glass bottle, and the peel off sanitary cover member; the twist off bottle cap having a number of evenly spaced grippable teeth extending outwardly from an internally threaded center cover portion; the molded glass bottle having a neck portion and a bottom portion; the neck portion terminating in a externally threaded neck member defining a dispensing opening and companionately threaded to engage and hold the twist off bottle cap in sealing relation to the dispensing opening of the externally threaded neck member; the bottom portion having a cap teeth engaging bottle cavity formed into a bottom surface thereof sized to receiving a twist off bottle cap therein and having a number of grippable teeth engaging protrusions that are sized and shaped to fit between evenly spaced grippable teeth of the twist off bottle cap; the peel off sanitary cover member being adhesively secured to the bottom surface of the bottom portion such that the cap teeth engaging bottle cavity is sealingly covered; the peel off sanitary cover member having a grip tab extending from a side edge thereof.
Figure 2:
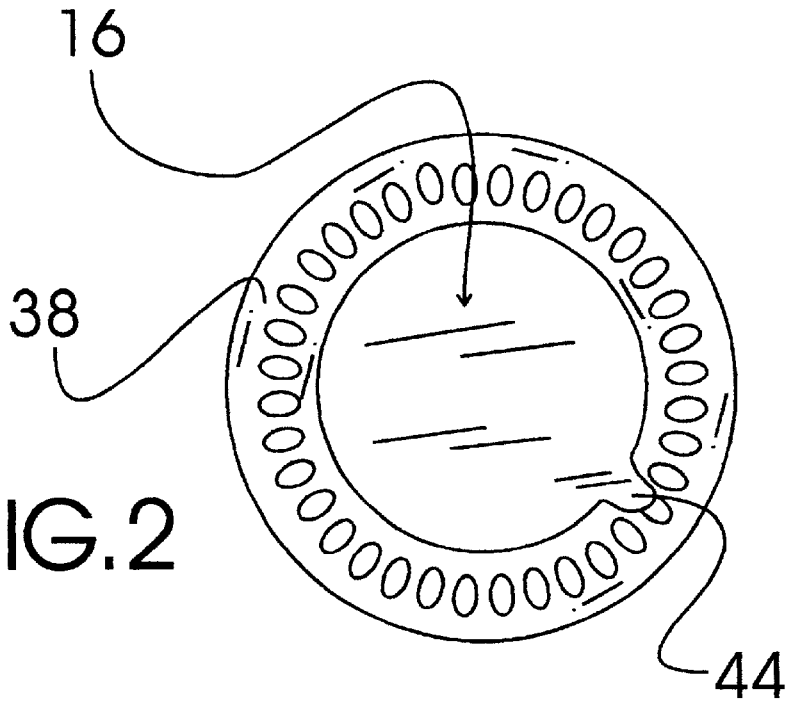
FIG. 2 is a bottom plan view showing the peel off sanitary cover member adhesively secured to the bottom surface of the bottom portion such that the cap teeth engaging bottle cavity is sealingly covered.
Figure 3:
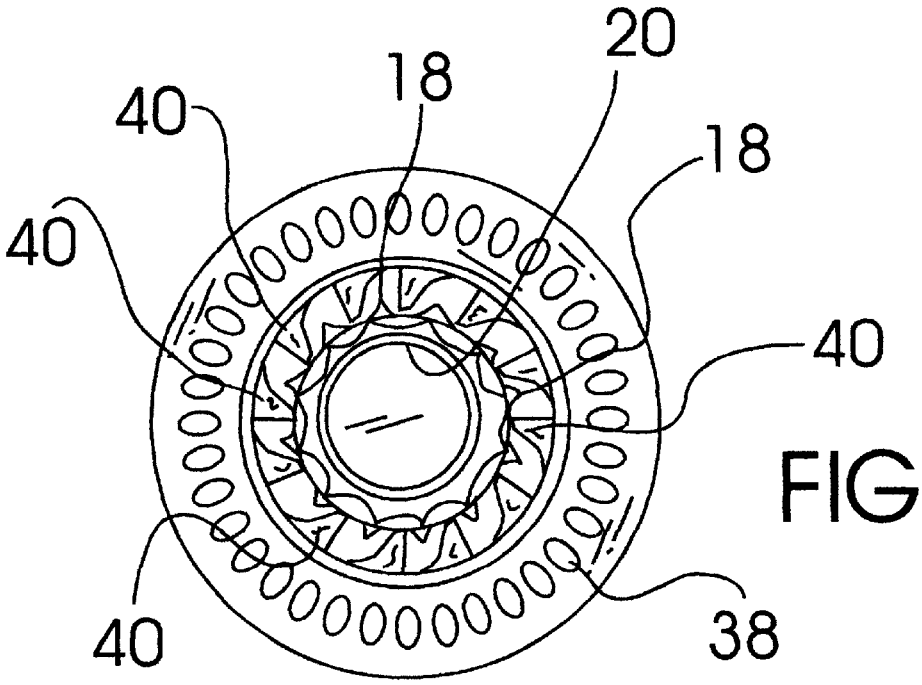
FIG. 3 is a bottom plan view showing the cap teeth engaging bottle cavity with the peel off sanitary cover member peeled away.

FIGS. 1–3 show various aspects of an exemplary embodiment of the bottle with integrally formed opener of the present invention generally designated 10. Bottle with integrally formed opener 10 includes a twist off bottle cap, generally designated 12; a molded glass bottle, generally designated 14; and a peel off sanitary cover member, generally designated 16.

Twist off bottle cap 12 has a number of evenly spaced grippable teeth 18 extending outwardly from an internally threaded center cover portion 20. Molded glass bottle 14 has a neck portion 22 and a bottom portion 24. Neck portion 22 terminates in an externally threaded neck member 28 defining a dispensing opening 30 and has companionate threads 32 to engage and hold twist off bottle cap 12 in sealing relation to dispensing opening 30.

Bottom portion 24 has a cap teeth engaging bottle cavity 36 formed into a bottom surface 38 thereof sized to receiving a twist off bottle cap 12 of another identical bottle 10 therein. Cap teeth engaging bottle cavity 36 also has a number of grippable teeth engaging protrusions 40 that are sized and shaped to fit between evenly spaced grippable teeth 18 of twist off bottle cap 12.

Peel off sanitary cover member 16 is formed from moisture impermeable material and is adhesively secured to bottom surface 38 of bottom portion 24 such that cap teeth engaging bottle cavity 36 is sealingly covered. In use, peel off sanitary cover member 16 is removed by gripping and pulling on a grip tab 44 that extends from a side edge 46 thereof. Sanitary cover member 16 keeps cap teeth engaging bottle cavity 36 protected from contaminants on surfaces such as table tops and the like prior to use to remove a twist off cap 12.

It can be seen from the preceding description that a bottle with integrally formed opener has been provided.

It is noted that the embodiment of the bottle with integrally formed opener described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A bottle with integrally formed opener comprising:

a twist off battle cap;

a molded glass bottle; and a peel off sanitary cover member;

said twist off bottle cap having a number of evenly spaced grippable teeth extending outwardly from an internally threaded center cover portion;

said molded glass bottle having a neck portion and a bottom portion;

said neck portion terminating in a externally threaded neck member defining a dispensing opening and companionately threaded to engage and hold said twist off bottle cap in sealing relation to said dispensing opening of said externally threaded neck member;

said bottom portion having a cap teeth engaging bottle cavity formed into a bottom surface thereof sized to receiving a twist off bottle cap therein and having a number of grippable teeth engaging protrusions that are sized and shaped to fit between evenly spaced grippable teeth of said twist off bottle cap;

said peel off sanitary cover member being adhesively secured to said bottom surface of said bottom portion such that said cap teeth engaging bottle cavity is sealingly covered;

said peel off sanitary cover member having a grip tab extending from a side edge thereof.

* * * * *